United States Patent [19]

Shinomiya et al.

[11] 3,957,543

[45] May 18, 1976

[54] METHOD FOR RINSING A CONVERSION COATED METAL SURFACE

[75] Inventors: Hiroshi Shinomiya, Yokohama; Kakuro Muro, Komae; Akimitsu Fukuda, Kawasaki; Yoshio Nagae, Tokyo; Yoshiji Shirogane, Zushi, all of Japan

[73] Assignee: Oxy Metal Industries Corporation, Warren, Mich.

[22] Filed: Feb. 1, 1974

[21] Appl. No.: 438,935

[30] Foreign Application Priority Data

Feb. 12, 1973 Japan ..... 48-16538

[52] U.S. Cl. ..... 148/6.15 R; 148/6.15 Z; 148/6.16; 148/22; 106/14; 252/389 A

[51] Int. Cl.[2] ..... C23F 7/08

[58] Field of Search ..... 148/6.15 R, 6.15 Z, 148/2 Z, 6.16, 6.17; 106/14; 252/389 A, 400 A

[56] References Cited

UNITED STATES PATENTS

| | | | |
|---|---|---|---|
| 2,973,308 | 2/1961 | Schimkus | 204/43 R |
| 3,007,818 | 11/1961 | Schimkus | 148/6.15 R |
| 3,591,665 | 7/1971 | Kimura et al. | 252/400 A |

OTHER PUBLICATIONS

Coler, M. A., Electrophoretic Deposition, In Encyclopedia of Chemical Technology, ed. by R. E. Kirk and D. F. Othmer, N.Y., Interscience Encyclopedia, Vol. 8, 1965, pp. 23–25.

*Primary Examiner*—Ralph S. Kendall
*Assistant Examiner*—Charles R. Wolfe, Jr.
*Attorney, Agent, or Firm*—Arthur E. Kluegel; Richard P. Mueller; Bertram F. Claeboe

[57] ABSTRACT

Disclosed is a composition and method for its use to improve the corrosion resistance of conversion-coated metal surfaces. The composition contains a myo-inositol phosphate ester or soluble salt thereof and is applied as a rinse of the conversion coating.

6 Claims, No Drawings

METHOD OF RINSING A CONVERSION COATED METAL SURFACE

DESCRIPTION OF THE INVENTION

This invention relates to a composition and method for the after-rinsing of a conversion coating on a metal surface. It is an object of this invention to provide a method for the after-rinsing of a conversion coating on a metal surface which can improve the corrosion resistance of the coating and painted surface and can inhibit the color change of painted film without employing environmentally objectionable components such as chromates.

It has heretofore been known to rinse conversion coatings based on phosphates or oxides with a dilute chromic acid solution in order to improve corrosion resistance. However, the after-rinsing treatment with a chromic acid solution cannot often be put into practical use without an installation of waste water treatment facilities sufficient to overcome problems of pollution caused by the toxicity of chromic acid waste. In addition, the after-rinsing of conversion coatings with chromic acid may have substantially no improvement in certain coating systems and may also have a shortcoming of color change in the subsequently applied paint film. It has now been discovered that the conversion coating can be after-rinsed by treating the coating with a solution containing a phosphate ester of myo-inositol which is combined with from 2 to 6 phosphate ions and/or a water soluble salt thereof in which at least one hydrogen atom is replaced by an ammonium, alkali metal, or alkaline earth metal ion. The concentration of the active ingredient is at least 0.05 grams/liter and the solution has a pH ranging from 2 to 12.

The "phosphate ester of myo-inositol which is combined with from 2 to 6 phosphate ions" as referred to herein thus includes myo-inositol di-, tri-, tetra-, penta- and hexa-phosphates. The water soluble salts of phosphate esters of myo-inositol include, for example, those salts in which at least one hydrogen is replaced by Na, K, Li, Mg, Ca, Sr, or Ba. The hexa-phosphate ester of myo-inositol bears the chemical name "phytic acid" and will be so referred to hereinafter. The myo-inositol phosphate esters useful in this invention may be characterized by the formula $$C_6H_6(OH)_n[OPO(OH)_2]_m$$

wherein $m = 2$–$6$ and $n = 6-m$. Since myo-inositol di- to penta-phosphate esters are usually derived by hydrolyzing phytic acid, phytic acid is the most commercially important ester. Phytic acid is present in natural cereal grains and is employed as a vitamin component. It is nontoxic.

The pH, concentration, temperature and treating time of the solution according to this invention should be adjusted depending on the type of metal surface to be treated, conversion coating and myo-inositol phosphate in the after-rinsing solution, paint to be applied and painting procedure. For example, when a steel surface has been coated with a conversion coating based on conventional phosphate, the pH of the after-rinsing solution is adjusted to a value of at least 2. When the pH is less than 2.0, the conversion coating based on phosphate is dissolved in a short time interval when contacted with the after-rinsing solution and no anti-corrosive effect is observed after painting. It is thus preferable to treat the conversion coating with the after-rinsing solution after adjusting its pH to a value ranging from 2.0 to 12.0. Such a solution having a pH of more than 12 has no effect as an after-treating solution. Best results are obtained at a pH of from 2.5 to 5. The concentration of the after-rinsing solution is at least 0.05 grams/liter, preferably 0.1 to 20 grams/liter. If the concentration is less than 0.05 grams/liter, no improvement in corrosion resistance can be obtained. The solution is used at a temperature ranging from normal water temperature or room temperatures up to 90°C, preferably at a temperature between room temperature and 60°C. The treating time may vary from 1 second to 10 minutes depending on the type and coating weight of the conversion coating and the particular myo-inositol solution employed. When the conversion coating is a type which is dissolved and when the pH is adjusted to a higher value, the restriction on the treating time becomes much less critical.

Where the surface is to be subsequently painted, it is often preferred not to bring extraneous ions and contaminants into the paint system especially in a painting procedure such as electrophoretic painting. To avoid this problem, the conversion coating may be rinsed with distilled or deionized water as the final rinsing step following the conversion coating and after rinsing steps. These added rinses do not interfere with the efficacy of the after-rinse of the invention. A final rinse with deionized water is altogether unnecessary where the after-rinse of the present invention remains uncontaminated.

The after-rinse solution may be applied to conversion coatings by any of the conventional procedures for contacting a liquid with a solid surface such as spraying, dipping, roll or flow coating procedures. The solution is applied to conversion coated metal surfaces after the thorough removal of conversion coating solution by rinsing with water. If desired, the solution may be applied after drying the rinsed surfaces. It is generally preferred to dry the metal surface treated with the after-rinse solution prior to painting. The drying may be effected by any means such as forced drying or by means of compressed air. Additionally, since the treatment with the after-rinse solution improves the corrosion resistance of the conversion coating per se, corrosion resistance of the thus-treated surface is improved even though the surface is dried while being exposed to the atmosphere. Still further, depending on the installation and conditions for application of the paint of a water soluble type, the metal surface may be painted even in the wet state with no change in the effect (e.g. in electrophoretic painting).

The process according to this invention is applicable as an after-rinsing process for paints and coating systems of all types and as an after-rinsing process for improving conversion coatings on metals including, for example, iron, steel, mild steel, steel galvanized with tin or zinc as well as on surfaces of tin, zinc, aluminum, copper, and brass, irrespective of the final painting treatment. The conversion coatings applicable to the after-rinsing according to this invention include, for example, those based on phosphates, chromates and oxalates.

The practice of this invention improves the corrosion resistance of painted coatings as well as that of the conversion coatings as a temporary anticorrosive treatment to an extent comparable to the improvement achieved by after-rinsing with the conventional chromic acid solution, particularly in the case of electrophoretic painting. Advantageously, the present after-rinse can prevent the color change of the painted film and can eliminate problems of waste treatment resulting from conventional treatment with a chromic acid solution. Since this invention employs a phosphate ester of myo-inositol and/or a water soluble salt thereof as the after-rinsing solution, it is non-chromic, colorless and non-toxic. Hence the treatment necessitates no waste water treatment to eliminate environmental pollution nor to reduce BOD or COD content of the waste water.

The electrophoretic painting process is described in Kirk-Othmer's *Encyclopedia of Chemical Technology*, 1965 Edition, 8:23. The paint deposition may be either cathodic or anodic and is typically performed using an aqueous emulsion containing 5–20% solids at 50–500 volts, a temperature of 20°–35°C, and a current density of 2–5 Amps/ft$^2$. The deposition period may vary depending on other processing conditions and the coating thickness desired. The article is then typically baked at a temperature of 150°C or higher for 15–30 minutes.

This invention will be further illustrated by means of the following examples wherein all percents are by weight unless otherwise specified.

EXAMPLE 1

Specimens of cold rolled steel strip with a size of 70 × 150 × 0.8 mm were degreased by spraying a solution of a weak alkaline degreasing agent ("Finecleaner No. 4322" manufactured by Nihon Parkerizing Co., Ltd.) in a concentration of 20 grams/liter at 60°C for 2 minutes, followed by rinsing with water to remove any residual degreasing agent. The specimens were then conversion coated by spraying a conversion coating solution based on zinc phosphate (containing 0.1% Zn; 1.2% $PO_4$; 0.5% $NO_3$; and 0.02% $NO_2$) at 60°C for 2 minutes, followed by rinsing with water to remove the residual coating solution. The coating weight on the specimens was 1.2 grams/m$^2$. The conversion coated specimens were then after-rinsed at 10°C for 10 seconds by dipping them in a solution of phytic acid which had been prepared by dissolving phytic acid (0.5 grams) in water (1000 c.c.), followed by adjusting the pH to a value of 3 with 0.01% sodium hydroxide solution. The treated specimens were then rinsed with deionized water, and air dryed.

The specimens were subsequently coated electrophoretically to film thickness of 20 microns with an electrophoretic paint of the maleic acid resin type and baked at 170°C for 30 minutes. The painted specimens were cross-scribed with two scratches of 10 cm length reaching to the substrate and tested by continuously spraying 5% salt solution on the scratched surface for 240 hours according to JIS Z-2371.

After the salt spraying test, the specimens were rinsed with water to remove rust on the coated film and dried. Transparent tape with a width of 5 cm was applied to the scratched specimens and then removed. Table I shows results of these tests.

CONTROLS 1 and 2

As controls, conversion coated specimens were prepared in the same manner as disclosed in Example 1 and treated, painted, baked and tested also in the same manner as in Example 1 except that the after-rinsing was effected only by rinsing with deionized water for Control 1 and by dipping the specimen in a dilute chromic acid solution (containing 0.05% $CrO_3$ and 0.02% $Cr_2O_3$) at 60°C for 30 seconds, followed by rinsing with deionized water for Control 2. The results obtained for the controls are also shown in Table I.

Table I

| After-Rinse Procedure | Appearance of painted film after removal of tape | |
|---|---|---|
| | Width of Paint Stripped from Scribe (mm) | Number of Spots Stripped |
| Example 1 | 2 | <5 |
| Control 1 | 3–4 | 10–20 |
| Control 2 | 2 | <5 |

EXAMPLE 2

Specimens were coated with a conversion coating based on zinc phosphate in Example 1. They were then dipped in a phytic acid solution (0.25 g/l) which had been adjusted to a pH value of 3 at a temperature of 60°C for 30 seconds followed by a deionized water rinse and air drying.

The specimens thus prepared were coated electrophoretically with an electrophoretic paint of an acrylic resin base to a film thickness of 25 microns and baked at 175°C for 20 minutes. Table 2 shows results obtained after the salt spray test for 96 hours in the same manner as disclosed in Example 1. Since no rust spots nor blisters were formed in this case, the results are represented by the width of painted film stripped from the cross-cut portion in mm.

CONTROLS 3 and 4

As controls, specimens were prepared by coating with a conversion coating based on zinc phosphate according to the procedure of Example 1 and treated, painted and tested under the same conditions as in Example 2. Control 3 was after-rinsed as in Control 1 and Control 4 as in Control 2. The results are also shown in Table II.

Table II

| After-Rinse Procedure | Width of Paint Film Stripped From the Scribed Portion (mm) |
|---|---|
| Example 2 | 6.5 |
| Control 3 | 11.0 |
| Control 4 | 7.5 |

EXAMPLE 3

Two sets of cold rolled steel specimens were coated with a conversion coating based on zinc phosphate by the procedure of Example 1, rinsed with water and air dried. The specimens were dipped in a phytic acid solution at a pH of 3 in a concentration of 0.25 grams/liter at 60°C for 30 seconds. One set of the after-rinsed specimens was air dried without rinsing with deionized water and another was rinsed with deionized water, followed by air drying.

The specimens were coated electrophoretically with an electrophoretic paint of maleic acid resin base to a thickness of 20 microns and baked at 170°C for 30 minutes. Table III shows results obtained after 240 hour salt spraying.

CONTROLS 5 and 6

As controls, specimens of the same cold rolled steel strip were prepared, treated, painted and baked under the same conditions as in Example 3 except that the after-rinsing was effected in Control 5 by rinsing with deionized water and in Control 6 by immersion in the dilute chromic acid solution of Example 1 at 60°C for 30 seconds, followed by rinsing with deionized water. The results are shown in Table III.

Table III

| After-Rinse Procedure | Appearance of painted film after removal of tape | |
|---|---|---|
| | Width of Paint Stripped from Scribe (mm) | Number of Spots Stripped |
| Example 3 | | |
| a) Dipping into a phytic acid solution without the subsequent rinsing with deionized water | 2–3 | 20–40 |
| b) Dipping into a phytic acid solution, followed by rinsing with deionized water | 1–3 | 20–40 |
| Control 5 | Completely Stripped | |
| Control 6 | 2–3 | 30–40 |

EXAMPLES 4–6

Specimens which had been degreased and rinsed with water according to the procedures of Example 1 were treated respectively with the following three types of conversion coating:

1. by spraying a conversion coating solution based on zinc phosphate (containing 0.1% of Zn, 1.2% of $PO_4$, 0.5% of $NO_3$ and 0.02% of $NO_2$) at 60°C for 2 minutes, followed by the removal of the residual coating solution,
2. by spraying a conversion coating solution based on calcium phosphate (containing 0.2% of Zn, 0.5% of Ca, 0.7% of $PO_4$ and 3.3% of $NO_3$) at 75°C for 2 minutes, followed by the removal of the residual coating solution.
3. by spraying a conversion coating solution based on iron phosphate (containing 1.0% of $PO_4$, 0.04% of $BrO_3$ and 0.3% of Na) at 50°C for 2 minutes, followed by the removal of the residual coating solution.

The conversion coated specimens were after-rinsed by dippping them into a phytic acid solution at a pH of 4.8 having a concentration of 1.3 grams of phytic acid per liter at 60°C for 30 seconds and then air dried.

The three sets of specimens were subjected to the salt spray test in the same manner as Example 1. Table 4 shows the time elapsed before the formation of rust on the surfaces.

CONTROLS 7–12

As controls, three other sets of specimens were treated respectively by the conversion coating procedures as disclosed in the preceding Example were after-rinsed with deionized water for Controls 7, 8 and 9 and by dipping in a dilute chromic acid solution (containing 0.01% of $CrO_3$ and 0.004% of $Cr_2O_3$) at 60°C for 30 seconds for Controls 10, 11 and 12, air dried and tested in the same manner as in Example 3. The results obtained are also shown in Table 4. In Table 4, A indicates that after-rinsing was effected by dipping the specimens into a phytic acid solution without rinsing with deionized water, B indicates after-rinsing with deionized water, and C indicates after-rinsing by dipping with a dilute chromic acid solution without the subsequent rinsing with deionized water.

Table IV

| | Type of Conversion Coating | Type of After-Rinse | Time Interval Until the Rust Formation (minutes) |
|---|---|---|---|
| Example 4 | Zn-phosphate base | Procedure A | 60 |
| Control 7 | " | Procedure B | 5 |
| Control 10 | " | Procedure C | 45 |
| Example 5 | Ca-phosphate Base | Procedure A | 60 |
| Control 8 | " | Procedure B | 15 |
| Control 11 | " | Procedure C | 45 |
| Example 6 | Fe-phosphate base | Procedure A | 30 |
| Control 9 | " | Procedure B | 5 |
| Control 12 | " | Procedure C | 30 |

EXAMPLE 7

Specimens degreased and rinsed with water in the same manner as disclosed in Example 1 were coated by spraying a conversion coating solution based on iron phosphate (containing 1.0% of $PO_4$, 0.5% of $ClO_3$, 0.3% of Na and 0.06% of $NO_3$) at 70°C for 2 minutes and the residual solution was removed. The treated specimens had a coating weight of 0.4 grams/m$^2$. The specimens coated with the conversion coating were after-rinsed by spraying a phytic acid solution at a pH of 3.0 in a concentration of 0.5 grams/liter at 10°C for 15 seconds, followed by rinsing with deionized water and air drying.

The specimens were painted with a solution paint of melamine resin base to a thickness of 20 microns and baked at 140°C for 20 minutes, and then tested 720 hours by the continuous salt spray test as in Example 1. The results are shown in Table V.

CONTROL 13

As a control, identically treated panels were after rinsed with deionized water only.

TABLE V

| After-rinse | Width of Paint film stripped from the Cross Scribed Portion |
|---|---|
| Example 7 | 0.5 |
| Control 13 | 2.2 |

EXAMPLE 8

Specimens were prepared in the same manner as disclosed in Example 1 except that the cold rolled steel strip was replaced by zinc galvanized steel strip and treated with a conversion coating solution based on zinc phosphate. The conversion coated specimens were after-rinsed by dipping them in a phytic acid solution at pH of 3.0 containing phytic acid in a concentration of 0.5 grams/liter at a temperature of 10°C for 10 seconds, followed by rinsing with deionized water and air drying.

The specimens thus treated were coated with a solution paint of melamine resin base to a thickness of 20 microns, baked at 140°C for 20 minutes and tested under continuous salt spray for 1972 hours. The results are shown in Table VI.

CONTROLS 14 and 15

As controls, specimens were coated with a conversion coating based on zinc phosphate as disclosed in Example 6, after-rinsed by rinsing with deionized water for Control 14 and by dipping them in a dilute solution of chromic acid (containing 0.05% of $CrO_3$ and 0.02% of $Cr_2O_3$) at 60°C for 30 seconds, followed by rinsing with deionized water for Control 15. The after-rinsed specimens were treated and painted under the same conditions as disclosed in the preceding Example. The results are also shown in Table VI.

TABLE VI

| After-Rinse | Width of Paint film stripped from the scribed portion (mm) |
|---|---|
| Example 8 | 8.0 |
| Control 14 | 14.0 |
| Control 15 | 7.0 |

What is claimed is:

1. In a method for imparting corrosion resistance to a metal surface wherein the surface is treated to form a conversion coating based on phosphates, chromates, oxalates or oxides thereon, the improvement comprising rinsing the conversion coated surface with an aqueous chromium-free solution containing at least one compound selected from the group consisting of the phosphate esters of myo-inositol having the formula:

$$C_6H_6(OH)_n[OPO(OH)_2]_m$$

wherein $m = 2$ to 6 and $n = 6-m$ and the water soluble salts thereof in a concentration of at least 0.05 g/l, said aqueous solution having a pH of from 2 to 12.

2. The method of claim 1 wherein said water soluble salts are selected from the group consisting of ammonium, alkali metal and alkaline earth metal salts.

3. The method of claim 1 wherein $m = 6$ and $n = 6$.

4. The method of claim 1 wherein said concentration is from 0.1 to 20 g/l.

5. The method of claim 1 wherein the pH is from 2.5 to 5.

6. The method of claim 1 wherein the surface is subsequently painted.

* * * * *